US005303835A

United States Patent [19]

Haber et al.

[11] Patent Number: 5,303,835

[45] Date of Patent: Apr. 19, 1994

[54] LYOPHILIZATION CAP AND METHOD

[75] Inventors: Terry M. Haber, Lake Forest; William H. Smedley, Lake Elsinore; Clark B. Foster, Laguna Niguel, all of Calif.

[73] Assignee: Habley Medical Technology Corporation, Laguna Hills, Calif.

[21] Appl. No.: 903,778

[22] Filed: Jun. 24, 1992

[51] Int. Cl.[5] ..... B65D 41/62; B65D 55/02

[52] U.S. Cl. ..... 215/247; 215/250; 215/274; 215/276; 215/317; 206/445

[58] Field of Search ..... 215/247, 250, 274, 317, 215/276; 220/306; 206/445

[56] References Cited

U.S. PATENT DOCUMENTS

| | | | |
|---|---|---|---|
| 1,431,871 | 10/1922 | Burnet | 215/247 |
| 3,301,425 | 1/1967 | Brandtberg | 215/274 |
| 3,532,244 | 10/1970 | Yates, Jr. | 215/274 X |
| 3,893,582 | 7/1975 | Kowalik | 215/274 X |
| 3,905,502 | 9/1975 | Wassilieff | 215/250 |
| 4,353,472 | 10/1982 | Burton et al. | 215/250 X |
| 4,456,143 | 6/1984 | Davis et al. | 215/274 X |
| 4,516,684 | 5/1985 | Walter | 215/274 X |
| 4,773,553 | 9/1988 | Van Brocklin | 215/274 X |
| 5,052,568 | 10/1991 | Simon | 215/317 X |
| 5,085,332 | 2/1992 | Gettig et al. | 215/274 X |

*Primary Examiner*—Horace M. Culver
*Attorney, Agent, or Firm*—Townsend & Townsend Khourie & Crew

[57] ABSTRACT

A sealing cap (2, 2a) is mounted to the open mouth of a pharmaceutical-containing container (20) which is to undergo lyophilization. The container has an outwardly extending mouth ring (26) with a shoulder (28) spaced apart from and facing away from the mouth (22). The sealing cap includes a body (4, 4a) having a through hole (6) covered by a piercible septum (16). The body includes radially deflectable fingers (30, 30a) which engage the mouth ring when the cap is at an open position, at which fluid flow into and out of the interior (38) of the container is substantially unhindered. The fingers also include surfaces (42, 42a) which engage the shoulder of the mouth ring when the cap seals the container mouth. The cap is locked into place using a lock ring (44, 44a) which engages the distal ends (47, 47a) of the fingers to keep the fingers engaged beneath the mouth ring. The sealing cap moves from the open to the sealed position using straight line, axial movement with simple fixtures.

21 Claims, 13 Drawing Sheets

93

LYOPHILIZATION CAP AND METHOD

BACKGROUND OF THE INVENTION

Some pharmaceuticals are more stable over time if certain volatile components are removed. The process for removing the volatile components is called lyophilization. Solvents, including water, are examples of the components to be removed. Typically, lyophilization is carried out at elevated temperatures in a lyophilization chamber or oven. Usually a vacuum is created to facilitate volatilization. This permits removal of the solvents by sublimation. The pharmaceutical to be lyophilized is commonly in the form of a slurry. The lyophilized pharmaceutical is usually reduced to a solid, typically in a powdered or a crystallized form.

Lyophilized pharmaceuticals are widely used in the clinical setting because of their long shelf life, ease of storage and transport, and their reliable purity. The shelf life is long because the pharmaceutical is in a dry, inert form. Storage and transport are relatively easy because the powder or crystal is light-weight compared to its liquid form. Also, there are usually not special temperature requirements such as refrigeration. Sealed in a container, the lyophilized pharmaceutical does not require delicate handling, but is rather durable.

The purity of the substance is reliable if the container is properly sealed because contamination is prevented. Contamination can include introduction of unwanted microorganisms, atmospheric water vapor, gases (including oxygen), and particulate matter. The long shelf life and reliable purity of lyophilized substances are dependent in part on their handling after lyophilization and on the integrity of the sealed container. The introduction of contaminants can occur after lyophilization but before sealing the container, or after sealing if the seal is inadequate or violated.

In some cases lyophilized pharmaceuticals are distributed in pharmaceutical cartridges of the type including a barrel, a piston at one end and a piercible septum held in place over the mouth at the other end of the cartridge by a metal band or cap. To prepare the cartridge for use, a double ended needle cannula is mounted to the cartridge. The cannula pierces the septum and introduces a reconstituting agent, such as a sterile saline solution, into the cartridge by manipulation of the piston in a conventional manner. Sometimes the lyophilized pharmaceutical is distributed in a vial or ampule instead of the cartridge assembly. The vial or ampule may be sealed by means of a top that is removable or piercible. The pharmaceutical may be reconstituted either by removing the top and adding the reconstituting agent or by inserting a double ended needle cannula through the piercible top and introducing the reconstituting agent through the cannula.

Once the pharmaceutical has been lyophilized, the mouth of the cartridge is sealed, typically with a septum held in place by a band or a cap. Although this could occur outside the lyophilization chamber, there are recognized advantages to sealing the lyophilized pharmaceutical-containing cartridge within the chamber. One advantage is that a clean, dry environment can exist in the chamber after the lyophilization process and before the chamber is opened. Sealing the container before removal from the chamber could reduce the risks of contamination and spill of the unsealed dried product. The result is simplified production of contained, sealed lyophilized substances.

One way to seal the cartridge while still in the oven would be to mount a sealing cap at the mouth of the cartridge. The cap would be configured to provide relatively unhindered fluid access between the lyophilization chamber and the interior of the cartridge through the mouth while the cap is in a first position. After lyophilization, it was conceived that the cap would be secured onto the cartridge in a second position causing the septum to cover the mouth. However, an acceptable configuration for the sealing cap and method for accomplishing this was not available prior to the present invention.

An attempt to accomplish sealing the container while within the lyophilization chamber is known in the prior art. A one piece polycarbonate plastic cap with two septums was used. The cap was to occupy a first position during lyophilization and a second position after lyophilization while still in the chamber. The cap was forced into position after lyophilization, but because the plastic deformed during the lyophilization process, the container leaked. The present invention solves some of the problems known in the prior art.

SUMMARY OF THE INVENTION

The present invention is directed to a sealing cap for use with a pharmaceutic container, typically a pharmaceutical cartridge, of the type which undergoes lyophilization. The cap is mountable to the mouth of the cartridge at a first, open, lyophilization position and at a second, sealing position using simple, axial movement. The two piece cap, including a body and a lock ring, may be presented in several forms. The ring may be frangibly connected to the body. Alternatively, the ring and body may be separately molded.

The container has an opening surrounded by a rim having an outwardly extending mouth ring. The mouth ring has a shoulder spaced apart from and facing away from the rim. The sealing cap preferably includes a body having a through hole; a piercible septum is positioned across the through hole. In the preferred embodiment, the body includes radially deflectable fingers sized and positioned to engage the mouth ring when the cap is at the first, unsealed, lyophilization position, at which fluid flow into and out of the interior of the container is substantially unhindered. The radially deflectable fingers also include portions which engage the shoulder of the mouth ring when the cap is at the second, sealed position, at which the cap seals the mouth of the container. Access to the interior of the container when the cap is in the sealed position is achieved through the piercible septum.

The cap is locked into place using a lock ring which engages the distal ends of the fingers to keep the fingers engaged with the shoulder of the mouth ring. The sealing cap is preferably configured to allow the body to be moved from the first, lyophilization position to the second, sealed position and to permit mounting the lock ring over the distal ends of the fingers using straight line, axial movement with simple fixtures.

A primary advantage of the invention is that it permits a lyophilized pharmaceutical cartridge to be sealed within the lyophilization chamber using a simple cartridge sealing fixture which moves in a simple, axial direction. This not only reduces the cost of the fixture, it facilitates increasing the packing density of the cartridges within the lyophilization chamber.

Another advantage of the invention is the use of inwardly deflectable segments on the cap on which external threads can be formed. The threads are used when a needle assembly is mounted directly to the cartridge. By allowing the segments to be inwardly deflectable, the cap is easier to mold using a mold which is less complex. Alternatively, the lock ring can be made much longer with the external threads formed at the outer end of the lock ring.

A further advantage of the invention is achieved by molding the lock ring as one piece with the cap, the lock ring being temporarily secured to the cap by frangible connections. This reduces cost and simplifies assembly.

Additionally, the invention teaches the use of a network of cap bodies and a network of their corresponding lock rings. Use of these networks simplifies the assembly of cap bodies, lock rings and containers to create a sealed container.

Other features and advantages of the invention will appear from the following description in which the preferred embodiments have been set forth in detail in conjunction with the accompanying drawings.

DESCRIPTION OF THE PREFERRED EMBODIMENTS

Figure 1:
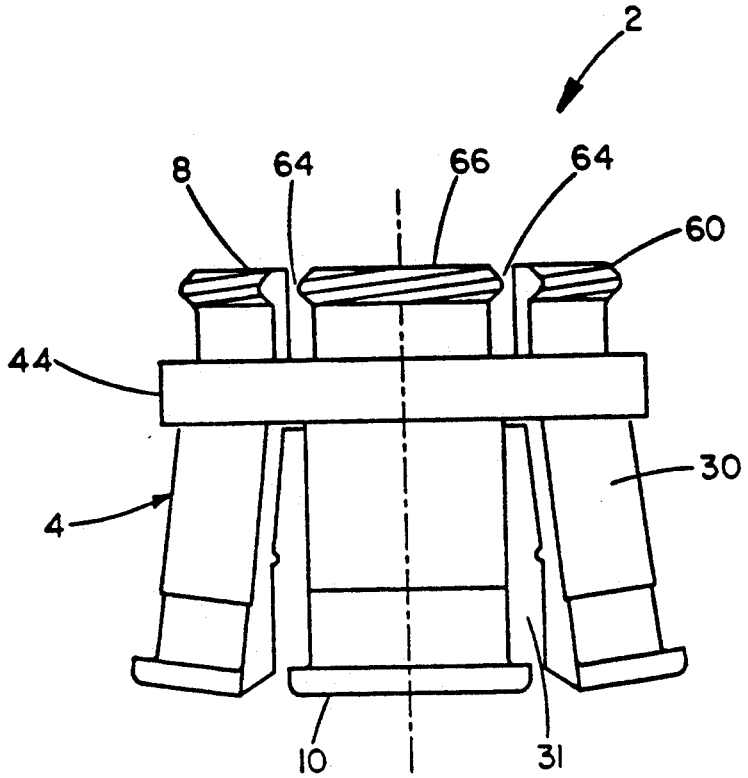
FIG. 1 is a side view of a sealing cap made according to the invention.
Figure 2:
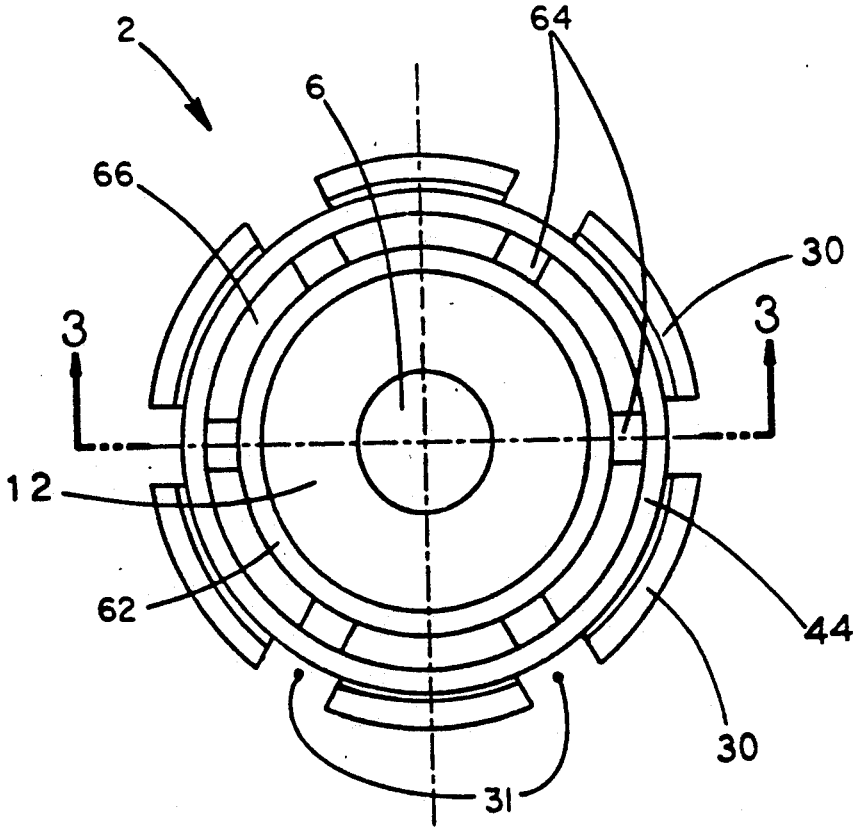
FIG. 2 is a top plan view thereof.
Figure 3:
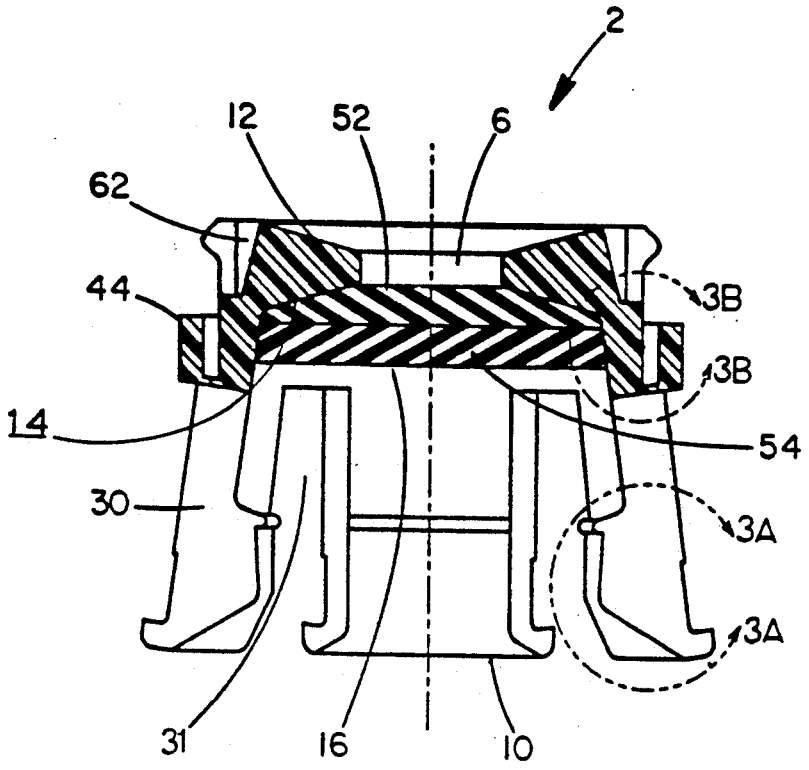
FIG. 3 is a cross-sectional view taken along line 3—3 of FIG. 2.
Figure 3A:
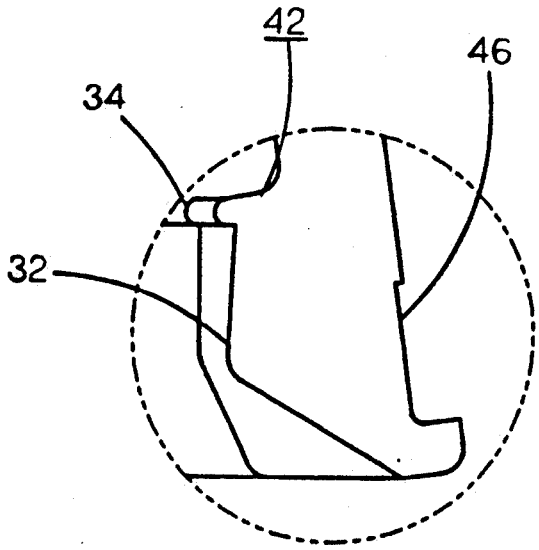
FIGS. 3A and 3B are enlarged views taken along lines 3A—3A and 3B—3B of FIG. 3.
Figure 3B:
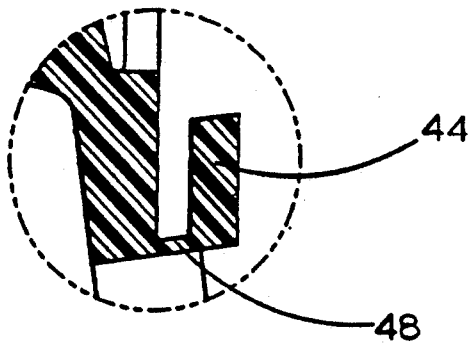

Referring to FIGS. 1-3, a sealing cap 2 especially adapted for use with lyophilized pharmaceutical cartridges is shown. Cap 2 includes a body 4 having a through hole 6 extending from an outer end 8 to an inner end 10. Body 4 includes a constricted region 12 at outer end 8 having an inner surface 14 against which a septum 16 is positioned. As suggested in FIGS. 4 and 5, sealing cap 2 is configured to mount to a mouth end 18 of a container 20. Container 20 has a mouth 22 circumscribed by a rim 24 and surrounded by a radially outwardly extending mouth ring 26. Mouth ring 26 extends between rim 24 and a shoulder 28 which faces away from rim 24. To position cap 2 at the first, lyophilization position of FIG. 4, body 4 includes a number of radially deflectable elements. These radially deflectable elements are preferably fingers 30 separated by gaps 31, however other arrangements are possible. For example, a continuous member contrived to resemble a pleated skirt could be used. In the preferred embodiment, fingers 30 define a first, radially inwardly facing engagement surface 32, shown in FIG. 3A, which terminates at a radially inwardly extending ridge 34. Surface 32 engages an outer surface 36 of mouth ring 26. Ridge 34 and the resilience of fingers 30 keep cap 2 in the first, lyophilization position of FIG. 4 allowing substantially unhindered fluid flow between interior 38 of container 20 and the ambient environment 40, as suggested by arrow 41.

Figure 4:
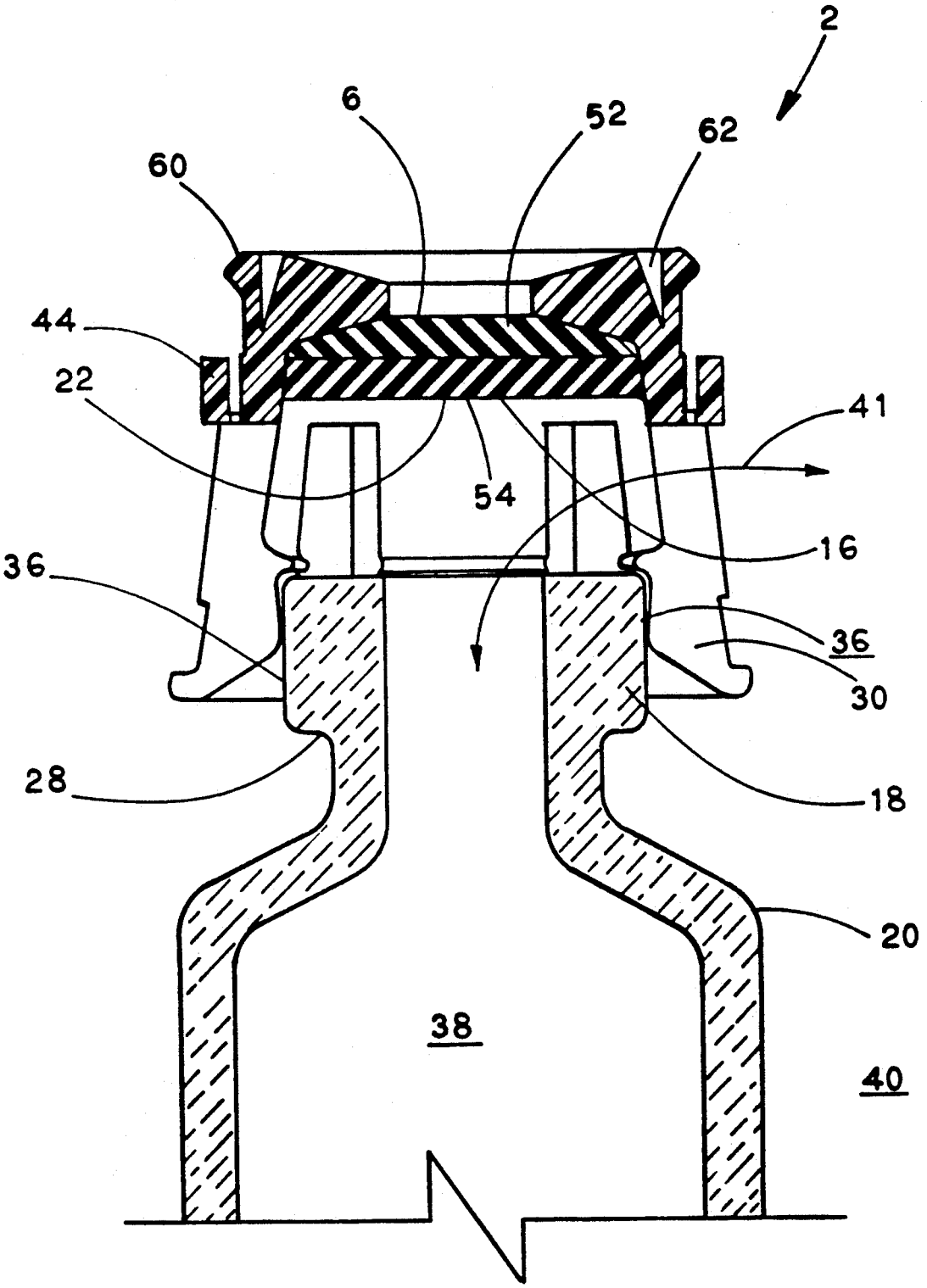
FIG. 4 is a side cross-sectional view of the sealing cap of FIG. 1 shown mounted over the mouth of a container at a first, open, lyophilization position.
Figure 5:
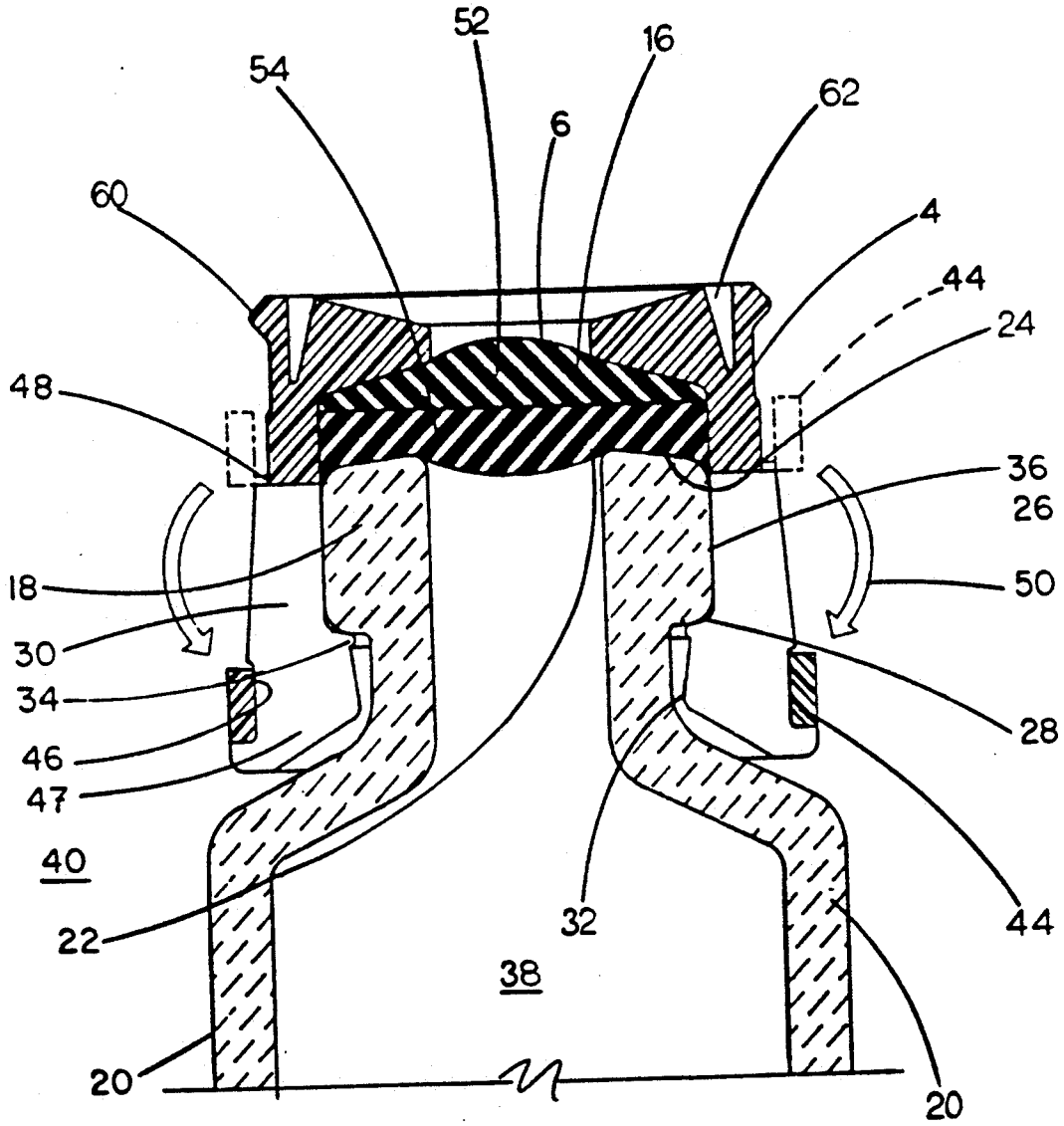
FIG. 5 shows the sealing cap of FIG. 4 in a second, sealed position with the septum sealing the mouth of the container and the lock ring engaging the fingers to lock the sealing cap to the container.

To seal container 20, cap 2 is driven axially from its first position of FIG. 4 into its second, sealed position of FIG. 5. Doing so causes surface 32 and ridge 34 to move past shoulder 28 to permit a generally radially extending locking surface 42 adjacent ridge 34 to engage shoulder 28. To lock cap 2 in place, a lock ring 44 is moved to a position past shoulder 28 into a shallow groove 46 formed at the distal ends 47 of fingers 30. Ring 44 is molded as one piece with body 4 and is frangibly attached to fingers 30 at connections 48. An axial force is exerted on lock ring 44 to move the lock ring axially into shallow groove 46 to secure engagement of locking surface 42 with shoulder 28 as suggested by arrows 50. With cap 2 in the second, sealed position of FIG. 5, septum 16 seals mouth 22.

Septum 16 is of a known composition, preferably a two layer composition of butyl rubber. The outer layer 52 is a soft butyl rubber with a hardness of about 30 durometer. The inner layer 54 is a somewhat firmer elastomeric butyl rubber having a durometer hardness of about 50. Other compositions for septum 16 can be used as well. Body 4 is preferably of a polycarbonate thermoplastic sold under the trademark Calibre by Dow Chemical, USA. Although it is preferred that lock ring 44 and body 4 be a one piece molded part, ring 44 could be a separately formed piece, such as one made of medical grade 304 stainless steel.

Figure 7A:
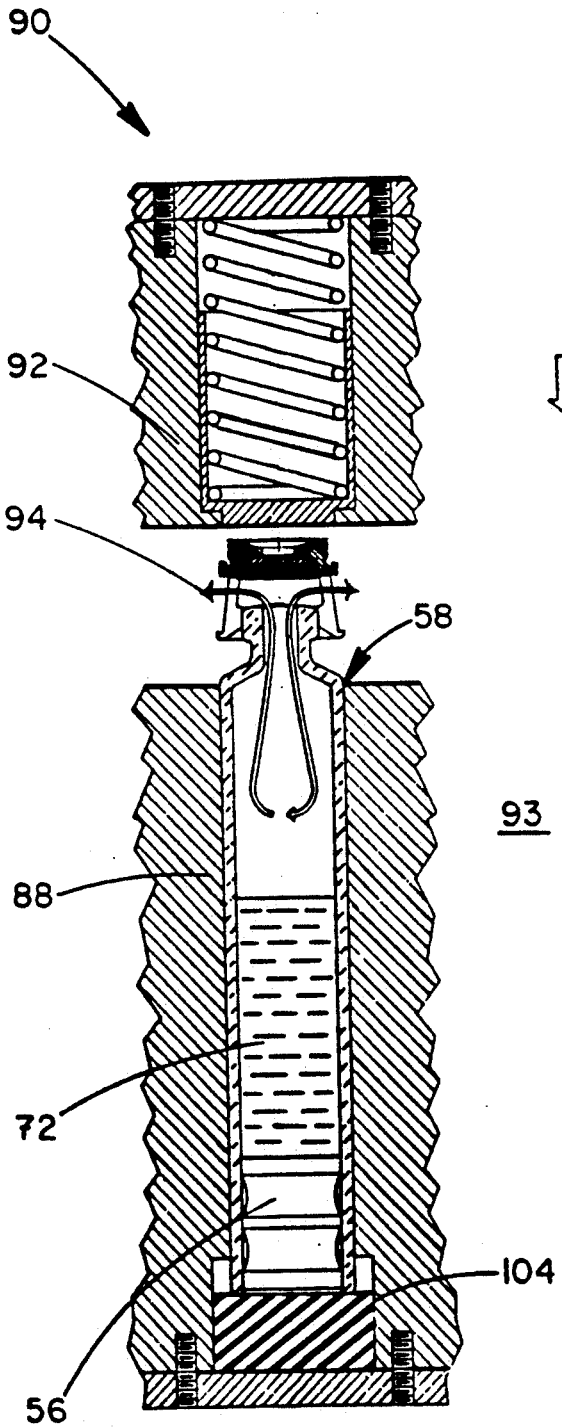
FIG. 7A illustrates the container and sealing cap of FIG. 6C mounted between upper and lower halves of a cartridge sealing fixture within a lyophilization chamber to permit any volatile components to be removed from the pharmaceutical within the cartridge.
Figure 7B:
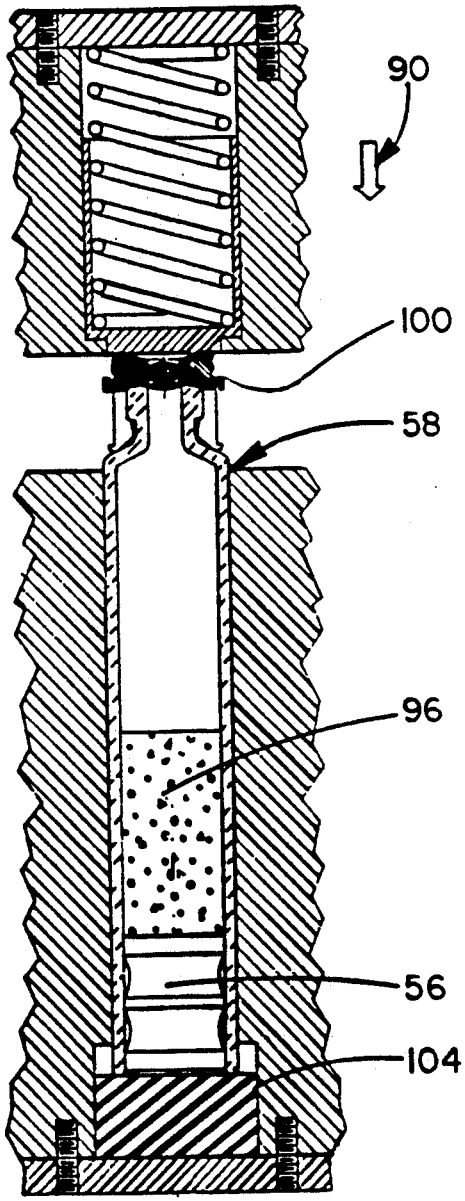
FIG. 7B shows the cartridge of FIG. 7A after lyophilization and after the upper half of the cartridge sealing fixture has moved downwardly to move the body of the sealing cap from the position of FIG. 4 to the position of FIG. 5.
Figure 7C:
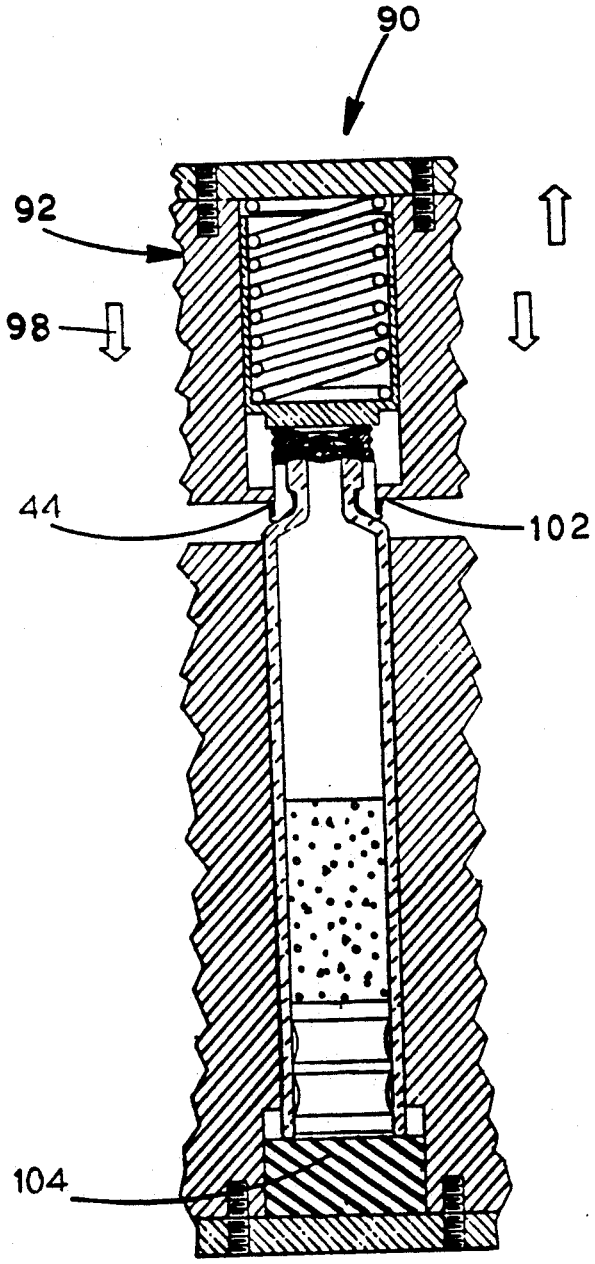
FIG. 7C shows the upper half of the sealing fixture of FIG. 7B as it continues to move downwardly breaking the frangible connection between the lock ring and the body of the sealing cap and driving the lock ring into position below the shoulders of the mouth ring of the container, thus locking the fingers in place.
Figure 7D:
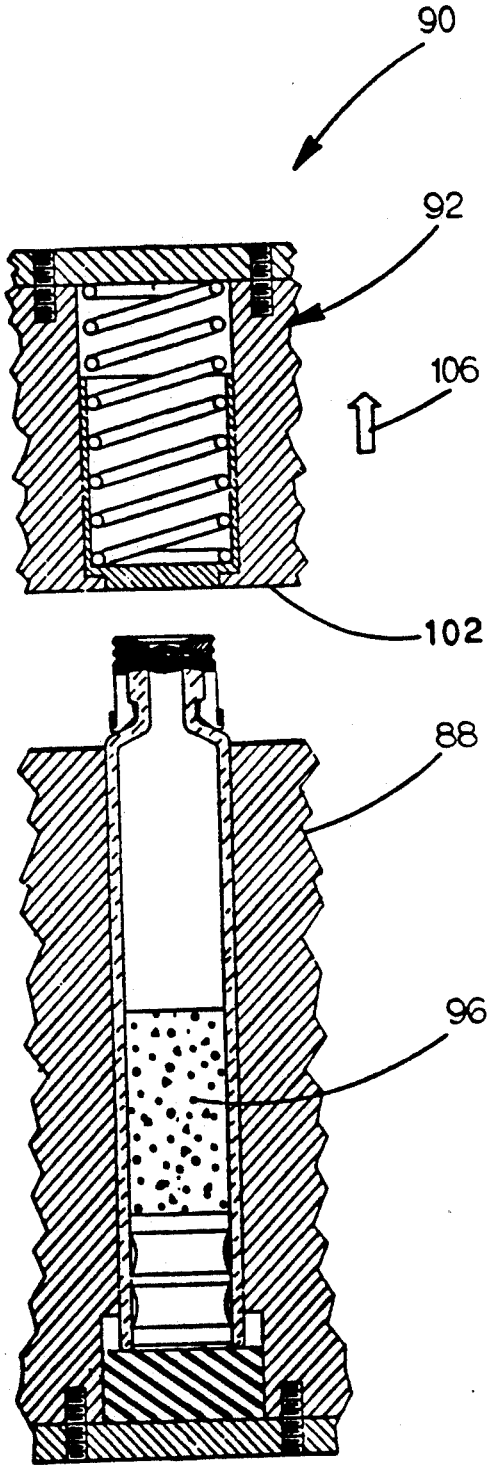
FIG. 7D shows the lyophilized cartridge of FIG. 7C after the upper half of the cartridge sealing fixture has moved axially away from the lower half to permit the lower half and lyophilized cartridge therewith to be removed from the lyophilization chamber.

As suggested in FIG. 7D, container 20 is preferably of the type which includes a piston 56 so that container 20, cap 2 and piston 56 constitutes a pharmaceutical cartridge having a piercible septum 16. In some cases it is desired to mount a double ended needle to cartridge 58 using a threaded or twist lock fastening system, as is conventional. To accommodate this, body 4 has one or more threads 60 formed at outer end 8. To reduce the mold complexity when making body 4, outer end 8 is formed with an annular cutout or relief 62 and a plurality, preferably six, evenly spaced axially extending slots 64. This permits threaded portions 66 to flex inwardly when sealing cap 2 is removed from the mold. As a result, the mold is less complex and thus less costly. At normal operating temperatures, that is, below about 120° F., threaded portions 66 are sufficiently rigid to permit a conventional needle assembly to be securely mounted thereto.

Figure 6A:
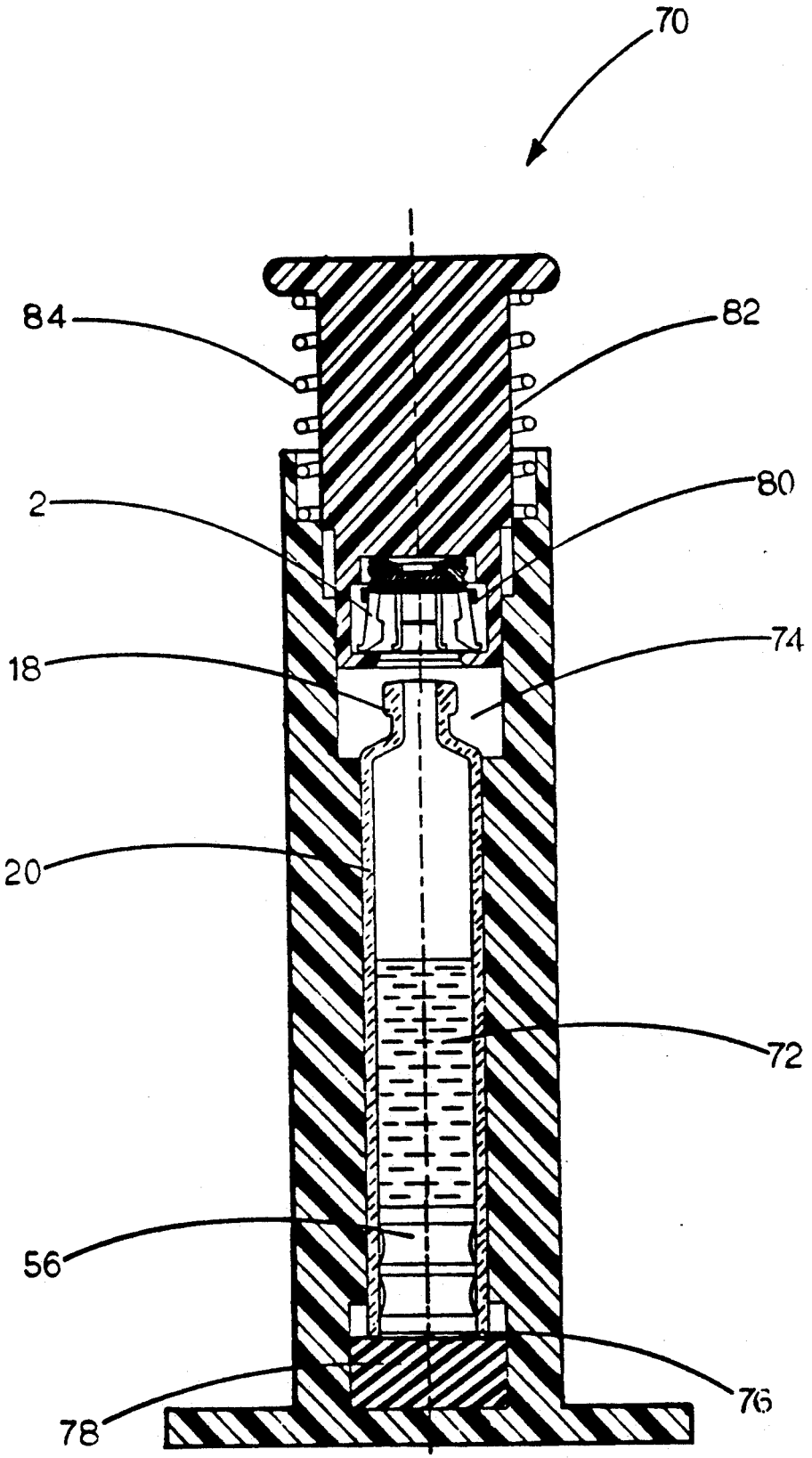
FIG. 6A illustrates a cartridge assembly fixture holding a cartridge-type container and positioning the sealing cap of FIG. 4 above the mouth of the container.
Figure 6B:
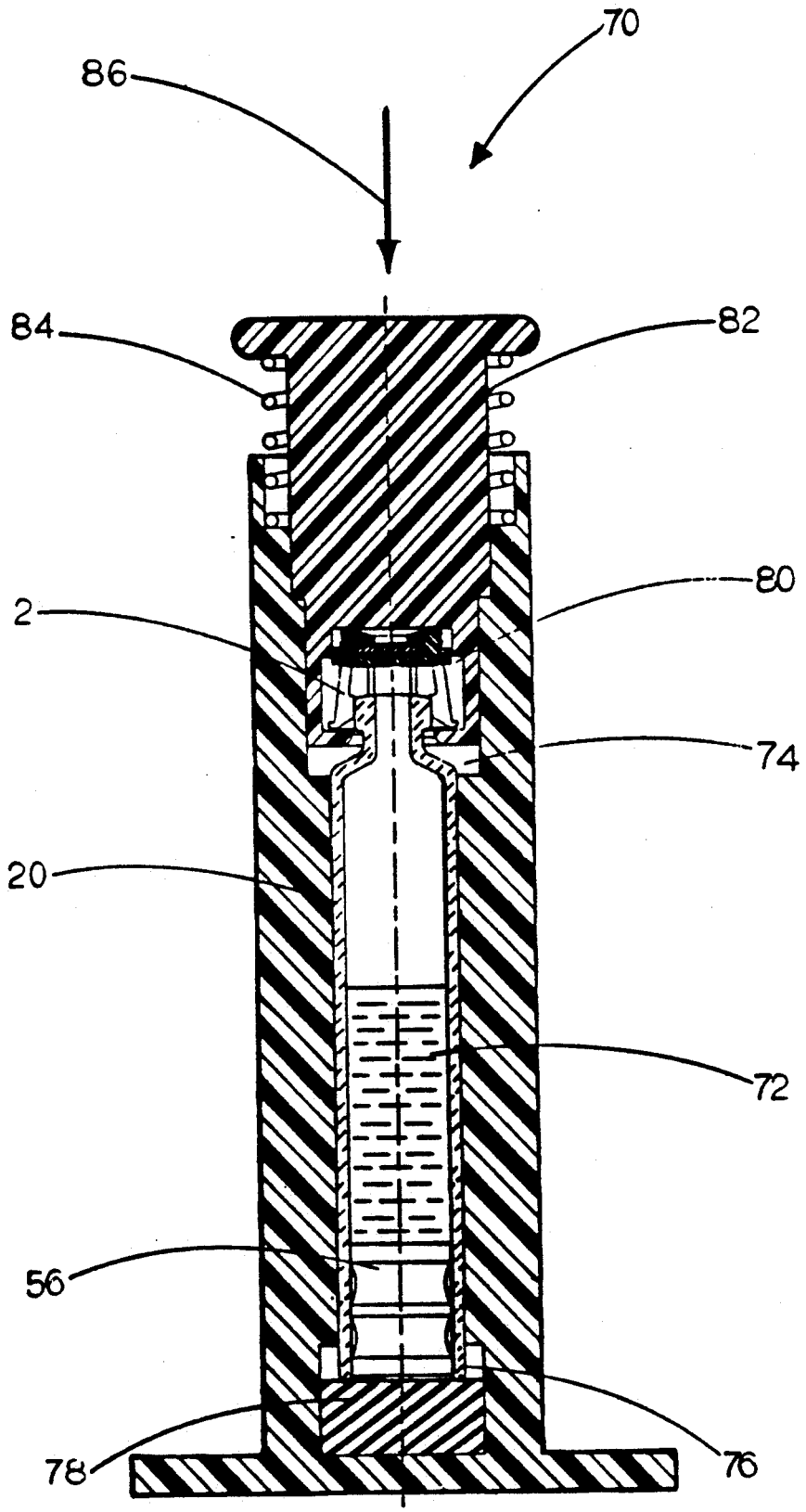
FIG. 6B shows the container and sealing cap of FIG. 6A with the sealing cap driven axially downwardly onto the container to the first, open, lyophilization position of FIG. 4.
Figure 6C:
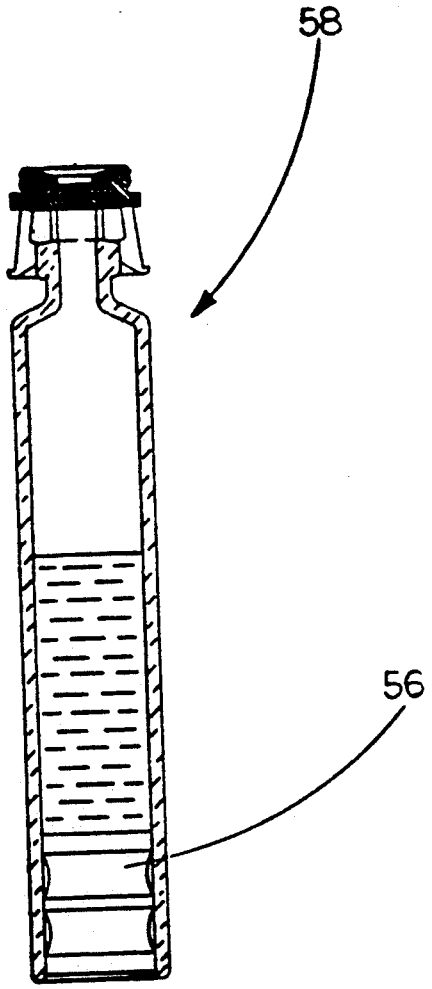
FIG. 6C shows the container and sealing cap of FIG. 4 after removal from the cartridge assembly fixture.

Turning to FIGS. 6A–6C, a container 20 is shown mounted within a cartridge assembly fixture 70. Container 20 has piston 56 at one end and contains a pharmaceutical 72, typically in the form of a slurry including one or more volatile components. Fixture 70 includes an open-sided main chamber 74 into which container 20 is moved laterally. The plunger end 76 of container 20 rests on an elastomeric cushioning block 78 to protect container 20, which is typically made of glass, as cap 2 is mounted to its mouth end 18. Cap 2 is housed within an open-sided supplemental chamber 80 and is placed in the supplemental chamber laterally. Supplemental chamber 80 is formed within a moveable portion 82 of fixture 70 and is biased away from cushion block 78 by a spring 84. To position sealing cap 2 at the first, lyophilization position of FIG. 4, and thus create cartridge 58, portion 82 is moved in the direction of arrow 86 of FIG. 6B until surface 32 engages outer surface 36 of mouth ring 26. Cartridge 58 is then removed from open sided fixture 70 to provide the user with a pharmaceutical-containing cartridge 58 ready for lyophilization.

FIGS. 7A–7D illustrate the steps involved and the fixtures used during lyophilization. FIG. 7A illustrates cartridge 58 of FIG. 6C mounted within the lower half 88 of a cartridge sealing fixture 90. Cartridge sealing fixture 90 also includes an upper half 92 both of which are within a conventional lyophilization oven. The ambient environment 93, with which the interior 38 of container 20 is in fluid communication, typically includes a nitrogen atmosphere at a raised temperature, such as 200° F. (93° C.). As indicated by arrows 94, the high temperature nitrogen environment allows volatile components of pharmaceutical 72 to be removed from the pharmaceutical and exhausted from the oven. After lyophilization, what remains within pharmaceutical cartridge 58 is a lyophilized pharmaceutical 96, which may be in a dry (powdered or crystalline) form. The dry form typically provides the pharmaceutical with an extended shelf life.

As illustrated in FIG. 7B, cap 2 is moved from its first, open position of FIG. 4 to its second, sealed position of FIG. 5 by the movement of upper half 92 in the direction of arrows 98. Doing so causes a spring biased driving element 100 to press on cap 2. Continued movement of upper half 92, as shown in FIG. 7C, causes an annular portion 102 of upper half 92 to engage lock ring 44 and drive the lock ring to the locked position of FIG. 5. During these movements, axial forces are resisted by an elastomeric block 104, which acts as an axial shock absorber for cartridge 58. Once lock ring 44 is in its locked position within shallow groove 46, upper half 92 moves in the direction of arrows 106 of FIG. 7D.

All these steps of FIGS. 7A–7D take place within the lyophilization oven. After the step of FIG. 7D, lower half 88 is removed from the lyophilization oven to permit cartridge 58 containing the lyophilized pharmaceutical 96 to be removed from lower half 88 for packaging and distribution. As is evident from FIGS. 6A–7D, all actions taken in mounting cap 2 to container 20 and all actions taken in sealing cap 2 to the container in the lyophilization oven are accomplished through simple axial movements. Lyophilization ovens commonly contain several shelves for holding numerous containers containing the pharmaceutical to be lyophilized. By designing cap 2 so that only axial movements are needed to mount the cap to container 20 and lock the cap in place, fixtures can be relatively simple. The main requirement is to properly align lower and upper halves (88 and 92) so that annular portion 102 properly engages lock ring 44. In the event that the lock ring is not integrally molded with the remainder of body 4, the lock ring could be carried by upper half 92 or placed over the body so it rests on the outwardly flared fingers 30.

Figure 8A:
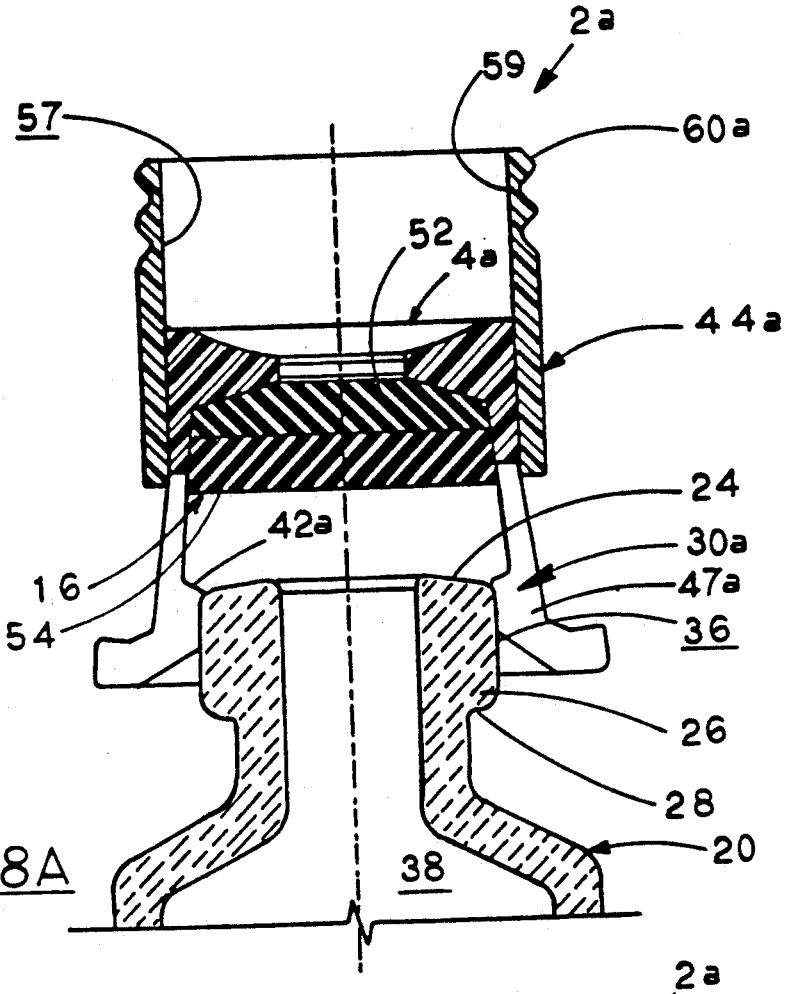
FIGS. 8A and 8B show an alternative embodiment of the invention at a first, lyophilization position and a second, sealed position.
Figure 8B:
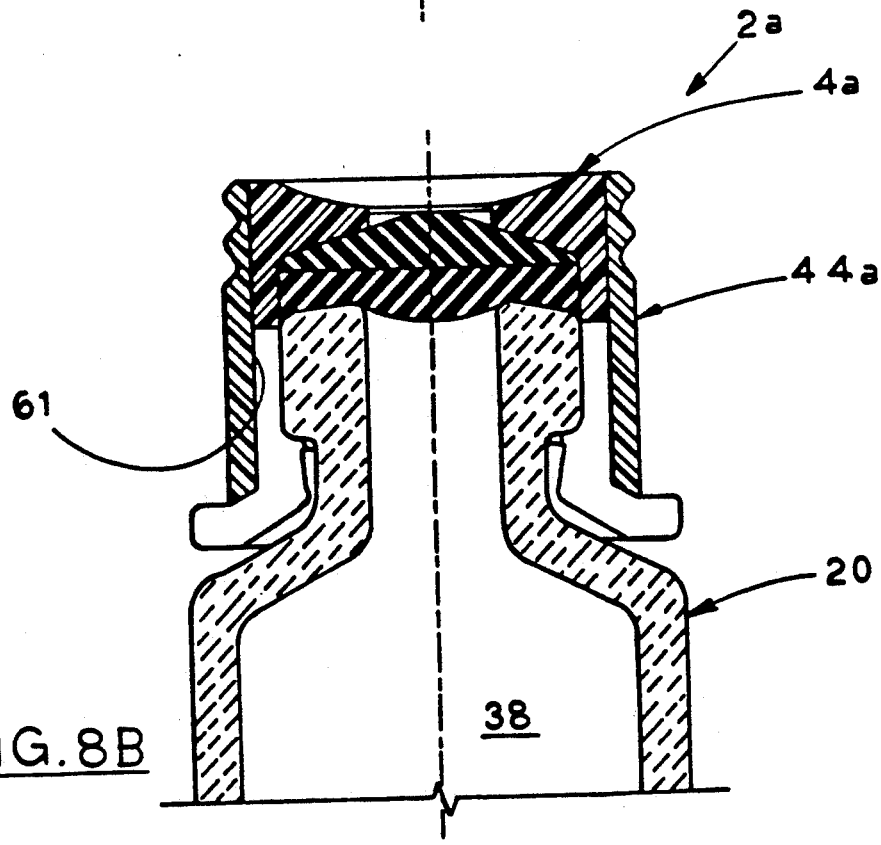

FIGS. 8A and 8B illustrate a second embodiment of the invention in the open, lyophilization position of FIG. 4 and the sealed position of FIG. 5. Sealing cap 2*a* is similar to sealing cap 2 with like reference numerals referring to corresponding parts. Lock ring 44*a* is formed separately from body 4*a* and is preassembled to body 4*a* as shown in FIG. 8A. The interior surface 57 of lock ring 44*a* has an upper half 59 which has a diameter which is slightly (1 mm) larger than the lower half 61. Body 4*a* is sized to fit within and be maintained within lower half 61 with a light push fit. The degree of interference is just sufficient to keep body 4*a* and lock ring 44*a* in their assembled condition of FIG. 8A. Lock ring 44*a* has threads 60*a* formed on its outer surface to eliminate the need for forming threads on body 4*a* and thus the need for an annular relief 62 or slots 64 as in sealing cap 2.

Once lyophilization is complete, sealing cap 2*a* is moved from the position of FIG. 8A to the position of FIG. 8B. This occurs by simply pressing down on lock ring 44*a*. Due to the smaller diameter of upper half 59, sealing cap 2*a* moves as a unit until septum 16 presses against rim 24; at this point distal ends 47*a* of fingers 30*a* are beneath shoulder 28 as shown in FIG. 8B but body 4*a* is still within lower half 61 of inner surface 57 as shown in FIG. 8A. Continued force on lock ring 44*a* forces the lock ring to the position of FIG. 8B so that lock ring 44*a* moves down over fingers 30*a* to secure lock surface 42*a* against shoulder 28. The friction of lock ring 44*a* against fingers 30*a* and body 4*a* and the opposition of fingers 44*a* against the container holds sealing cap 2*a* in place and prevents leakage of the contents of the container.

The arrangement depicted in FIGS. 8A and 8B is advantageous because it avoids spring mechanisms or other complicated assembly means. FIG. 8A depicts an arrangement that would be placed within the lyophilization chamber. The invention conveniently requires simple axially directed force upon lock ring 44*a* to achieve the first, or open, lyophilization position of FIG. 8A and then the second, or sealed, position of FIG. 8B.

Figure 9:
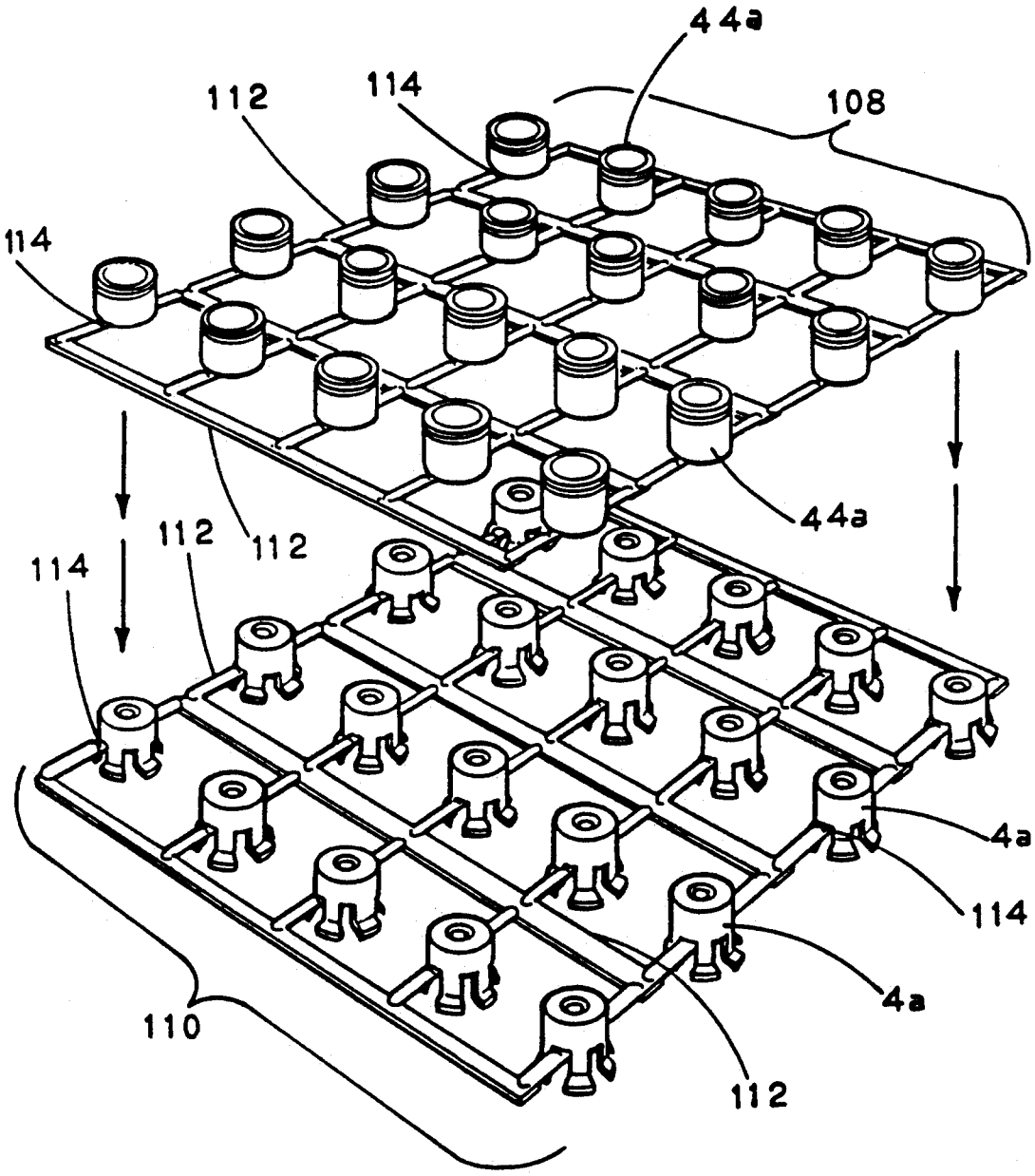
FIG. 9 shows networks of lock rings and of caps.

The sealing caps 2*a* may be assembled from bodies 4*a* and lock rings 44*a* in convenient groups or networks 10B and 110 by means of frangible connections 114 and removable webbing 112. See FIG. 9. Cap bodies 4a are assembled into a network 110 by means of frangible connections 114 and removable webbing 112. Similarly, lock rings 44a are assembled into a corresponding network 108. This arrangement facilitates manufacture, assembly and use of sealing cap 2a. A network 108 of lock rings 44a is placed on a network 110 of cap bodies 44a corresponding to the first, or lyophilization, position of FIG. 8A.

It is contemplated that assembled networks 108 and 110 are arranged over a corresponding rack or set of containers 20. The set of containers 20 and networks 108 and 110 are then placed in the lyophilization chamber and lyophilization is carried out. After lyophilization, but before removing the set of containers 20 and associated networks 108, 110 from the lyophilization chamber, axially directed force pushes lock rings 44a down on to bodies 4a to seal caps 2a in place. The set of assembled and sealed caps 2a and containers 20 are removed from the chamber. Removable webbing 112 may be removed at this point, or it may be left intact for convenient packing and shipping. In similar fashion, portions or subsets of assembled sealed caps 2a and containers 20 may be removed.

To further facilitate efficiency, containers 20 may be held in a baseplate (not shown). This baseplate would have container-sized openings positioned congruent to the configuration of the networks 110, 108 of cap bodies 4a and rings 44a. Thus, the baseplate would serve as support for containers 20 and would hold containers 20 in an arrangement corresponding to cap bodies 4a and lock rings 44a. In this fashion, a baseplate supporting containers 20 would be conveniently aligned with networks 110, 108 of cap bodies 4a and rings 44a. With these components aligned, sealing the containers takes place with a single application of axial force.

Figure 10:
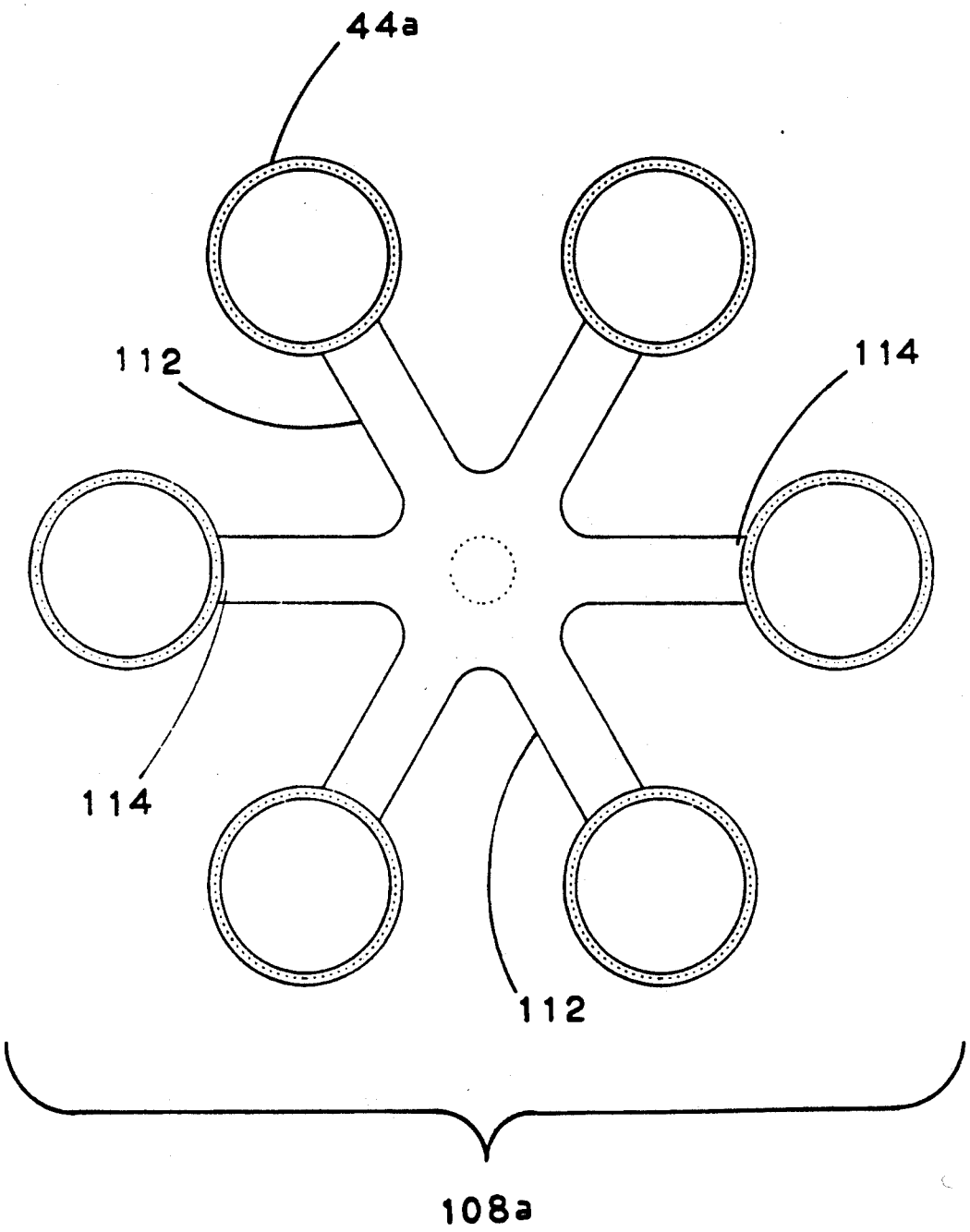
FIG. 10 shows an alternative embodiment of a network of lock rings.
Figure 11:
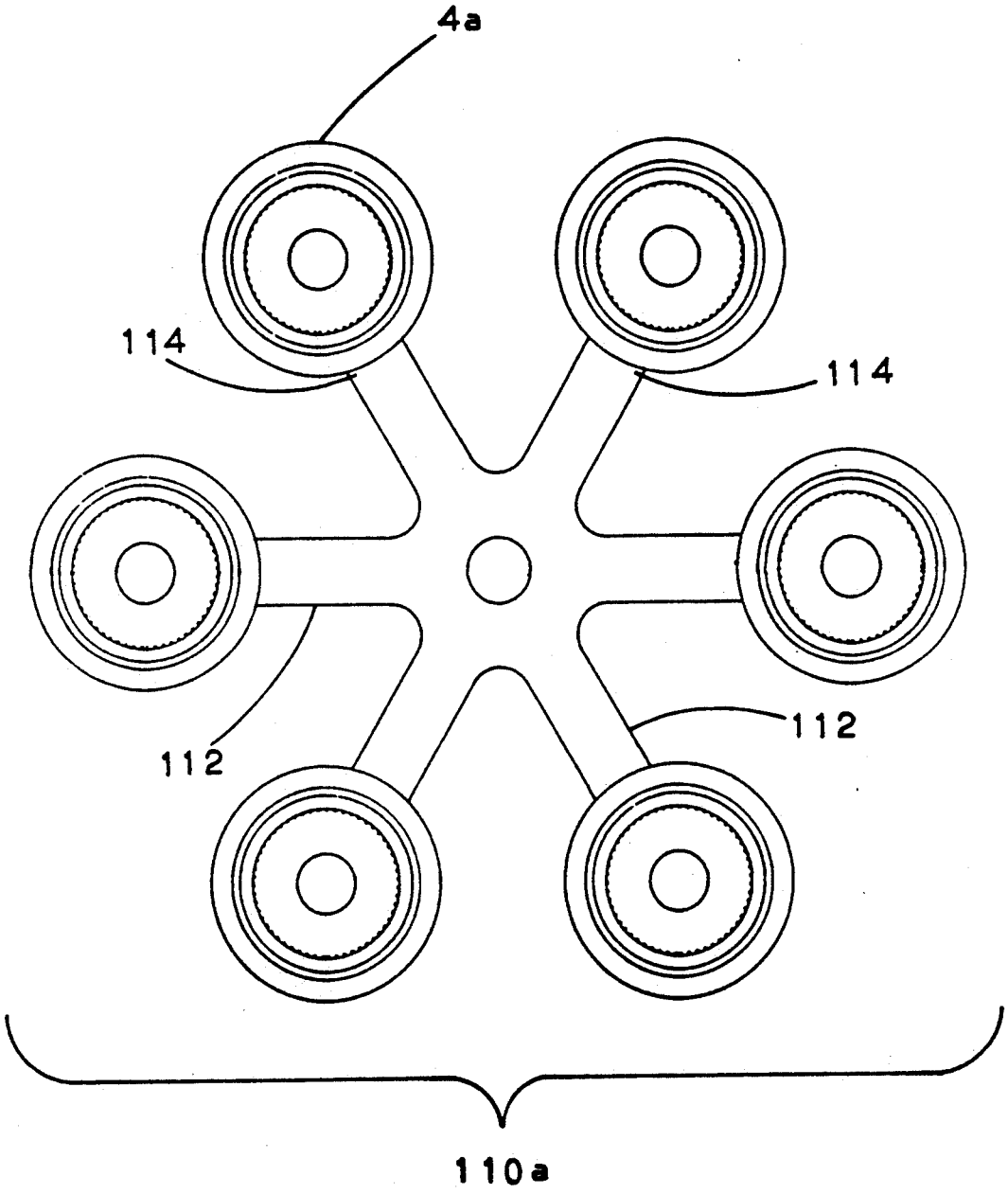
FIG. 11 shows an alternative embodiment of a network of cap bodies.

Modification and variation can be made to the disclosed embodiments without departing from the subject of the invention as defined in the following claims. For example, cap 2 could be made with a solid top instead of septum 16. Additionally, networks 108 and 110 may be arranged in patterns other than those exemplified in FIGS. 9, 10 and 11. The pattern may vary with the type or configuration of lyophilization chamber available, packing density requirements, shipping requirements and other factors.

What is claimed is:

1. A sealing cap for use with a pharmaceutical container of the type which undergoes lyophilization, the container having an interior terminating at an open mouth surrounded by a rim and having an outwardly extending mouth ring, the mouth ring having a shoulder facing away from the rim, the cap comprising:

a body including an outer end and an inner end, said outer end of the body including an external thread;

the body including a container engaging means, including at least one radially deflectable element, for mounting the cap to the container at a first, lyophilized position, at which fluid flow through the mouth into and from the container interior is substantially unhindered, and a second, sealed position, at which the cap seals the mouth of the container; and an axially movable lock ring which locks the cap to the container when the cap is at the second position.

2. The sealing cap of claim 1 wherein the body includes:

a through hole extending from the outer end to the inner end; and a piercible septum positioned across the through hole at the outer end, access through the mouth to the interior of the container when the cap is in the second position being through the piercible septum.

3. The cap of claim 2 wherein the septum is positioned opposite the rim so the septum seals the mouth when the cap is at the second position.

4. The cap of claim 1 wherein the outer end of the body includes radially deflectable segments on which the thread is formed so to aid removal of the body from a mold.

5. The cap of claim 1 wherein the lock ring includes said external thread.

6. The cap of claim 1 wherein said at least one radially deflectable element includes a plurality of radially deflectable fingers.

7. An assembly of more than one cap of claim 1 wherein said caps are joined by frangible connections.

8. The assembly of claim 7 wherein said assembly is oriented with the caps upright and the top surface of the caps are in the same plane.

9. The assembly of claim 7 wherein the lock means for each of the caps includes a ring movable to a locking position at which at least a portion of the ring is on a side of the shoulder away from the rim.

10. An assembly of claim 9 wherein said ring is one of a network of rings joined by frangible connections.

11. The assembly of claim 10 wherein the rings are oriented in the same axial direction.

12. The assembly of claim 11 wherein the rings include far ends which are in the same plane.

13. A cap sealing cap for use with a pharmaceutical container of the type which undergoes lyophilization, the container having an interior terminating at an open mouth surrounded by a rim and having an outwardly extending mouth ring, the mouth ring having a shoulder facing away from the rim, the cap comprising:

a body including an outer end and an inner end;

the body including a container engaging means, including a plurality of radially deflectable fingers, for mounting the cap to the container at a first, lyophilized position, at which fluid flow through the mouth into and from the container interior is substantially unhindered, and a second, sealed position, at which the cap seals the mouth of the container, said radially deflectable fingers including:

mouth ring engaging portions sized and positioned to engage the mouth ring when the cap is at the first position; and shoulder engaging portions sized and positioned to engage the shoulder when the cap is at the second position; and an axially movable lock ring which locks the cap to the container when the cap is at the second position.

14. The cap of claim 13 wherein the ring is movable to a locking position at which at least a portion of the ring is on a side of the shoulder away from the rim.

15. The cap of claim 14 wherein the ring is frangibly attached to the body when the cap is in the first position.

16. The cap of claim 14 wherein the ring is a plastic ring.

17. A sealing cap for use with a pharmaceutical cartridge of the type which undergoes lyophilization, the cartridge having an interior terminating at an open mouth surrounded by a rim and having an outwardly extending mouth ring, the mouth ring having a shoulder facing away from the rim, the cap comprising:

a molded body including:

an outer end and an inner end, the outer end of the body including radially deflectable segments on which an external thread is formed so to aid removal of the body from a mold;

a through hole extending from the outer end to the inner end; and a cartridge engaging means for mounting the cap to the cartridge at a first, lyophilization position, at which fluid flow through the mouth into and from the cartridge interior is substantially unhindered, and a second, sealed position, at which the cap seals the mouth of the cartridge;

a piercible septum positioned across the through hole at the outer end, access through the mouth to the interior of the cartridge when the cap is in the second position being through the piercible septum; and an axially movable lock ring which locks the cap to the cartridge when the cap is at the second position.

18. A sealing cap for use with a pharmaceutical container of the type which undergoes lyophilization, the container having an interior terminating at an open mouth surrounded by a rim and having an outwardly extending mouth ring, the mouth ring having a shoulder facing away from the rim, the cap comprising:

a body including an outer end and an inner end;

the body including a plurality of container engaging fingers for mounting the cap to the container at a first, lyophilized position, at which fluid flow through the mouth into and from the container interior is substantially unhindered, and a second, sealed position, at which the cap seals the mouth of the container;

the fingers including mouth ring engaging portions sized and positioned to engage the mouth ring when the cap is at the first position, and shoulder engaging portions sized and positioned to engage the shoulder when the cap is at the second position; and a lock ring carried by the body and movable from an initial position to a locking position at which at least a portion of the lock ring is on a side of the shoulder away from the rim for locking the cap to the container when the cap is at the second position.

19. The cap of claim 18 wherein the lock ring is frangibly attached to the body when the cap is in the first position.

20. The cap of claim 18 wherein the lock ring is slidably mounted to the body.

21. The cap of claim 20 wherein the lock ring has an internal surface which engages the body, the internal surface including means for hindering movement of the lock ring from the initial position to the locking position.

* * * * *